US009102187B1

(12) United States Patent
Zhong

(10) Patent No.: US 9,102,187 B1
(45) Date of Patent: Aug. 11, 2015

(54) RING BINDER MECHANISM

(71) Applicant: CHUNG TIN INTERNATIONAL, INC., Irvine, CA (US)

(72) Inventor: Jiagui Zhong, Shenzhen (CN)

(73) Assignee: CHUNG TIN INTERNATIONAL, INC., Irvine, CA (US)

( * ) Notice: Subject to any disclaimer, the term of this patent is extended or adjusted under 35 U.S.C. 154(b) by 0 days.

(21) Appl. No.: 14/607,909

(22) Filed: Jan. 28, 2015

(30) Foreign Application Priority Data

| | | |
|---|---|---|
| Feb. 19, 2014 | (CN) | 2014 2 0071212 |
| Apr. 25, 2014 | (CN) | 2014 2 0208154 |
| Jan. 7, 2015 | (CN) | 2015 2 0007859 |

(51) Int. Cl.

| | |
|---|---|
| ***B42F 13/16*** | (2006.01) |
| ***B42F 13/20*** | (2006.01) |
| ***B42F 13/22*** | (2006.01) |

(52) U.S. Cl.
CPC ..... *B42F 13/22* (2013.01); *B42F 13/16* (2013.01); *B42F 13/20* (2013.01)

(58) Field of Classification Search
CPC ..... B42F 13/20; B42F 13/16
USPC ..... 402/29–31, 36–38, 41
See application file for complete search history.

(56) References Cited

U.S. PATENT DOCUMENTS

| | | | | |
|---|---|---|---|---|
| 974,831 | A * | 11/1910 | Scherzinger | 402/41 |
| 3,098,489 | A | 7/1963 | Vernon | |
| 3,288,115 | A | 11/1966 | Hechtle | |
| 3,652,173 | A | 3/1972 | Miller et al. | |
| 3,819,282 | A | 6/1974 | Schultz | |
| 3,954,343 | A | 5/1976 | Thomsen | |
| 4,130,368 | A | 12/1978 | Jacoby | |
| 4,566,817 | A | 1/1986 | Barret, Jr. | |
| 5,895,164 | A | 4/1999 | Wu | |
| 6,276,862 | B1 * | 8/2001 | Snyder et al. | 402/41 |
| 6,749,357 | B2 | 6/2004 | Cheng et al. | |
| 6,840,695 | B2 | 1/2005 | Horn | |
| 7,275,886 | B2 | 10/2007 | Cheng | |
| 7,296,946 | B2 | 11/2007 | Cheng et al. | |
| 7,331,732 | B2 | 2/2008 | Kaneda | |
| 7,404,685 | B2 | 7/2008 | Cheng | |
| 7,491,006 | B2 | 2/2009 | Whaley | |
| 7,524,128 | B2 | 4/2009 | Cheng et al. | |
| 7,530,755 | B2 | 5/2009 | Whaley | |
| 7,534,064 | B2 | 5/2009 | Cheng | |
| 7,549,817 | B2 | 6/2009 | Cheng et al. | |
| 7,597,498 | B2 | 10/2009 | Cheng | |

(Continued)

*Primary Examiner* — Kyle Grabowski
(74) *Attorney, Agent, or Firm* — Jeffer Mangels Butler & Mitchell LLP; Brennan C. Swain, Esq

(57) ABSTRACT

A ring binder mechanism that includes a housing, first and second hinge boards positioned in the housing that cooperate to define a slot having a closing edge and an opening edge. The hinge boards are pivotable between open and closed positions. A plurality of pairs of semi-rings include first and second ring members mounted on the first and second hinge boards, respectively. A travel bar is positioned below the hinge boards and moveable with respect to the housing and the hinge boards between an open position and a closed position. The travel bar includes at least one top bar extending from a top surface thereof that includes inclined opening and closing surfaces. The top bar extends through the slot in the hinge boards and is biased toward the open position. The inclined opening surface of the top bar contacts the opening edge of the slot to pivot the first and second hinge boards to the open position.

16 Claims, 9 Drawing Sheets

(56) References Cited

U.S. PATENT DOCUMENTS

| | | | | |
|---|---|---|---|---|
| 7,648,302 | B2 | 1/2010 | Zhang et al. | |
| 7,661,898 | B2 | 2/2010 | Ng et al. | |
| 7,661,899 | B2 | 2/2010 | Lin | |
| 7,665,926 | B2 | 2/2010 | Cheng | |
| 7,674,062 | B2 | 3/2010 | Horn | |
| 7,704,005 | B2 | 4/2010 | Lin | |
| 7,726,897 | B2 | 6/2010 | To et al. | |
| 7,731,441 | B2 | 6/2010 | Ng et al. | |
| 7,744,300 | B2 | 6/2010 | Cheng et al. | |
| 7,748,922 | B2 | 7/2010 | Cheng | |
| 7,758,271 | B2 | 7/2010 | Cheng | |
| 7,762,734 | B2 | 7/2010 | Cheng et al. | |
| 7,828,491 | B2 | 11/2010 | Cheng | |
| 7,878,729 | B2 | 2/2011 | Cheng et al. | |
| 7,891,901 | B2 | 2/2011 | Cheng et al. | |
| 7,950,867 | B2 | 5/2011 | Lin | |
| 8,002,488 | B2 | 8/2011 | Cheng | |
| 8,038,361 | B2 | 10/2011 | Cheng et al. | |
| 8,043,018 | B2 | 10/2011 | Cheng et al. | |
| 8,047,737 | B2 | 11/2011 | Pi et al. | |
| 8,052,343 | B2 | 11/2011 | Zhang et al. | |
| 8,186,899 | B2 | 5/2012 | Ng et al. | |
| 8,414,212 | B2 | 4/2013 | Cheng et al. | |
| 8,480,326 | B1 | 7/2013 | Wong | |
| 8,517,624 | B2 | 8/2013 | Warmus | |
| 8,573,876 | B2 | 11/2013 | Cheng et al. | |
| 8,801,317 | B2 | 8/2014 | Pi et al. | |
| 8,814,458 | B2 | 8/2014 | Lin | |
| 2005/0100396 | A1 | 5/2005 | Barabas | |
| 2005/0201820 | A1 | 9/2005 | Ng et al. | |
| 2005/0260030 | A1 | 11/2005 | Wong | |
| 2006/0056906 | A1 | 3/2006 | Horn | |
| 2006/0147254 | A1 | 7/2006 | Cheng | |
| 2007/0086836 | A1 | 4/2007 | Chen | |
| 2007/0134052 | A1 | 6/2007 | Nelson et al. | |
| 2007/0134054 | A1 | 6/2007 | Li | |
| 2008/0050171 | A1 | 2/2008 | Cheng et al. | |
| 2008/0085145 | A1 | 4/2008 | To et al. | |
| 2008/0175651 | A1 | 7/2008 | Cheng | |
| 2008/0175652 | A1 | 7/2008 | Cheng et al. | |
| 2008/0199246 | A1 | 8/2008 | To et al. | |
| 2009/0041532 | A1* | 2/2009 | Cheng et al. | 402/38 |
| 2009/0060631 | A1 | 3/2009 | To et al. | |
| 2011/0020053 | A1 | 1/2011 | Cheng | |
| 2011/0170942 | A1 | 7/2011 | Huang et al. | |
| 2012/0121317 | A1* | 5/2012 | Warmus | 402/31 |
| 2012/0121318 | A1* | 5/2012 | Warmus | 402/56 |
| 2012/0230755 | A1 | 9/2012 | Ng et al. | |
| 2014/0140754 | A1 | 5/2014 | Whaley | |
| 2014/0186094 | A1 | 7/2014 | Lin | |
| 2014/0199111 | A1 | 7/2014 | Wong | |
| 2014/0205361 | A1 | 7/2014 | Warmus | |
| 2014/0205362 | A1 | 7/2014 | Warmus | |
| 2014/0270903 | A1 | 9/2014 | Horn | |
| 2014/0341633 | A1 | 11/2014 | Lin | |
| 2014/0348570 | A1 | 11/2014 | Whaley | |

* cited by examiner

RING BINDER MECHANISM

FIELD OF THE INVENTION

The present invention relates to a ring binder mechanism for holding loose leaf paper.

BACKGROUND OF THE INVENTION

A ring binder is a stationary accessory, generally called loose-leaf binder in the art. It can protect documents securely and safely, ensure smooth flipping of documents and will not scratch documents. The hook-rings can be tightly engaged. It features an elegant appearance and a stable structure and is unlikely to be scratched or sink in. The whole binder has a high strength and is unlikely to become deformed. A binder generally comprises a long bar-shaped housing, a pair of pivotable hinge boards inside the housing and clamped tightly by the housing, and semi-rings secured on the hinge boards. The semi-rings can be opened or closed by the pivoting of the hinge boards. When they are closed, the ends of the two corresponding semi-rings on the two hinge boards are pressed together, so that the two semi-rings form a complete hook-ring, to facilitate securing and flipping leaflets. When they are opened, the ends of the two corresponding semi-rings are separated, so that the leaflets can be taken out of or added into the binder through the opening between the two ends. The ring binders available on the market currently are opened or closed by using both hands to open the two semi-rings so as to drive the hinge boards to control the pulling force of opening or closing, which requires certain strength of the hands. In addition, the operation by both hands will cause an uncomfortable feel and have the problem of uneven strength between the hands, which is likely to damage the ring binder, resulting in increase in cost. When there are a large number of leaflets within the semi-rings, it will be very inconvenient to open or close the ring binder by both hands.

SUMMARY OF THE PREFERRED EMBODIMENTS

In accordance with a first aspect of the present invention there is provided a ring binder mechanism for securing loose leaf pages that includes a housing that defines a housing interior and first and second hinge boards positioned in the housing interior and configured to pivot relative to the housing. The first and second hinge boards cooperate to define a slot that includes opposite ends that include a closing edge and an opening edge. The first and second hinge boards are pivotable between a closed position and an open position. The ring binder mechanism also includes a plurality of pairs of semi-rings that each include a first ring member mounted on the first hinge board and moveable with the pivoting motion of the first hinge board and a second ring member moveable with the pivoting motion of the second hinge board. The first and second ring members each are pivotable between a closed position and an open position and extend through an opening in the housing. The ring binder mechanism also includes a travel bar positioned below the hinge boards and moveable linearly with respect to the housing and the hinge boards between an open position and a closed position. The travel bar includes at least one top bar extending from a top surface thereof that includes an inclined opening surface and an inclined closing surface. At least a portion of the top bar extends through the slot in the first and second hinge boards and the travel bar is biased toward the open position. The inclined opening surface of the top bar contacts the opening edge of the slot to pivot the first and second hinge boards to the open position or the inclined closing surface of the top bar contacts the closing edge of the slot to pivot the first and second hinge boards to the closed position.

In a preferred embodiment, the inclined opening surface of the top bar contacts the opening edge of the slot to pivot the first and second hinge boards to the open position and the inclined closing surface of the top bar contacts the closing edge of the slot to pivot the first and second hinge boards to the closed position. Preferably the housing includes a recessed slot defined in an inner surface thereof and the top bar includes a top surface that is received in and is movable along the recessed slot of the housing.

In a preferred embodiment, the top bar includes a generally horizontal blocking surface adjacent the inclined closing surface, and the closing edge of the slot is positioned adjacent the blocking surface when the first and second hinge boards are in the closed position, such that the blocking surface blocks pivotal movement of the first and second hinge boards. Preferably, the travel bar is biased toward the open position by a spring that extends between the travel bar and one of the first and second hinge boards. In a preferred embodiment, the travel bar includes a push member extending upwardly from an end thereof that is positioned outside the housing interior. When the travel bar is in the open position, pushing the push member toward the housing moves the travel bar from the open position to the closed position. Preferably, the housing includes rails extending inwardly therefrom, wherein the travel bar rests on and moves along the rails. As described herein, the ring binder mechanism includes a number of ways for holding the travel bar in the closed position. In a preferred embodiment, the travel bar includes an elongated positioning slot defined therein, the housing includes a positioning tube extending downwardly from a top thereof and into the positioning slot, and the positioning tube abuts an end of the positioning slot when the travel bar is in the open position.

In a preferred embodiment, the travel bar includes a first straight slot defined therein. An opening assembly is positioned in the first straight slot and is secured to the housing. The opening assembly is axially extendable and contractable between an open position and a closed position. Preferably, the opening assembly includes a supporting sleeve and a connecting rod that extends through the supporting sleeve. The connecting rod has opposite ends that are connected to the travel bar, and the opening assembly includes a slide claw sheath that contacts an end of the first straight slot.

In a preferred embodiment, the travel bar includes a push member extending upwardly from an end thereof that is positioned outside the housing interior and a button on a side thereof that is biased outwardly therefrom. When the travel bar is in the closed position the button is in contact with a ledge on the housing. Preferably, the button includes an extension that is hingedly connected to the travel bar, and at least a part of the extension is positioned adjacent to an angled cut out defined in the travel bar.

In a preferred embodiment, the travel bar includes a push member extending upwardly from an end thereof that is positioned outside the housing interior and that includes an opening mechanism that includes a button that is received in a through chamber in the push member and is biased upwardly. Pushing downwardly on the button causes a ledge to clear an edge of the housing, thus allowing the travel bar to move to the open position.

In accordance with another aspect of the present invention there is provided a ring binder mechanism for securing loose leaf pages that includes a housing that defines a housing interior and first and second hinge boards positioned in the housing interior and configured to pivot relative to the housing. The first and second hinge boards cooperate to define a slot that includes opposite ends that include a closing edge and an opening edge. The ring binder mechanism also includes a plurality of pairs of semi-rings that each include a first ring member mounted on the first hinge board and moveable with the pivoting motion of the first hinge board and a second ring member moveable with the pivoting motion of the second hinge board. The first and second ring members each are pivotable between a closed position and an open position and extend through an opening in the housing. The ring binder mechanism also includes a travel bar positioned below the hinge boards and moveable linearly with respect to the housing and the hinge boards between an open position and a closed position. The travel bar includes at least one top bar extending from a top surface thereof. The top bar includes an inclined opening surface and an inclined closing surface and at least a portion of the top bar extends through the slot in the first and second hinge boards. The travel bar includes a push member extending upwardly from an end thereof that is positioned outside the housing interior such that when the travel bar is in the open position, pushing the push member toward the housing moves the travel bar from the open position to the closed position and the inclined closing surface of the top bar contacts the closing edge of the slot to pivot the first and second hinge boards to the closed position. The travel bar is biased toward the open position.

In a preferred embodiment, the inclined opening surface of the top bar contacts the opening edge of the slot to pivot the first and second hinge boards to the open position. Preferably, the housing includes a recessed slot defined in an inner surface thereof, and the top bar includes a top surface that is received in and is movable along the recessed slot of the housing. Preferably, the travel bar is biased toward the open position by a spring that extends between the travel bar and one of the first and second hinge boards.

The first embodiment described herein is intended to effectively overcome the shortcomings in technology stated above, and provide an automatic cyclic ring binder mechanism that has a simple structure, can accomplish the open-closing cycle when being pushed by one hand cyclically, and be operated comfortably, easily, simply and conveniently, thus reducing the cost of use.

The technical solution of the first embodiment disclosed herein is as follows: it comprises a housing, a pair of pivotable hinge boards inside the housing and clamped tightly by the housing, and a plurality of pairs of semi-rings secured on the hinge boards respectively; the semi-rings protrude from the upper surface of the housing. The automatic cyclic ring binder mechanism is characterized by the fact that it further comprises a push rod inside the housing that can move along the axis of the housing; the push rod is located beneath the hinge boards; a first straight slot and a second straight slot are arranged in the push rod from left to right along the axis of the housing; an automatically revolving push rod positioning bush is arranged inside the first straight slot; the upper end of the automatically revolving push rod positioning bush securely connects with the inner surface of the housing; a recoil spring is arranged inside the second straight slot; the recoil spring connects with the hinge boards; a plurality of top bars are arranged on the upper end of the push rod; a straight slot is arranged in the hinge boards in the position corresponding to that of the top bars; the top bars pass through the straight slot; a clamping slot matching with the front ends of the top bars is arranged in the inner surface of the housing.

In the aforesaid structure, the automatically revolving push rod positioning bush comprises a connecting rod, a cap covering the connecting rod, a supporting sleeve, a compression spring inside the supporting sleeve, a turntable sheath, and a slide claw sheath; the left end of the connecting rod connects with the left end of the first straight slot, and the right end of the connecting rod connects with the right end of the first straight slot; the upper end of the supporting sleeve securely connects with the inner surface of the housing; the left end of the supporting sleeve securely connects with the cap; three bosses parallel with the axis of the supporting sleeve are evenly distributed on the inner wall of the right end of the supporting sleeve; the right end of the turntable sheath extends into the slide claw sheath; the right end of the slide claw sheath is close to the right end of the first straight slot; a turntable and a slide claw are arranged at the left end of the turntable sheath and the left end of the slide claw sheath respectively; a groove corresponding to the bosses is arranged at the outer circumference of the turntable and of the slide claw respectively; the turntable sheath and the slide claw sheath can move along the bosses inside the supporting sleeve via the grooves; the slide claw sheath can drive the turntable sheath to move and revolve; a link block is arranged on the connecting rod; the link block is close to the left end of the turntable sheath; one end of the compression spring connects with the cap, and the other end connects with the link block.

In the aforesaid structure, the groove divides the outer circumference of the turntable into three turntable lugs of the same size; an inclined cambered face, a vertical straight face and an inclined straight face are arranged in order on the right ends of the turntable lugs; the inclined cambered face and the inclined straight face have the same direction of inclination; the groove divides the outer circumference of the slide claw into three pairs of slide claw lugs of the same size; each pair of the slide claw lugs comprises a first lug and a second lug separated from each other; the first lug and the second lug are of the same size and arranged side by side; the left ends of the first lug and the second lug have a first inclined face and a second inclined face respectively; the first inclined face corresponds to the inclined cambered face, and the second inclined face corresponds to the inclined straight face; when the first inclined face on the first lug presses the inclined cambered face, and the second inclined face on the second lug presses the inclined straight face, the turntable sheath revolves, the first lug is wedged in the groove on the turntable, and the left ends of the bosses contact with the inclined straight face.

In the aforesaid structure, a binder-opening face, a binder-closing face and a top surface formed integrally are arranged on the top bars in order; the front ends of the top surface of the top bars match with the clamping slot.

In the aforesaid structure, a check stand is arranged at the left and in the right end of the upper end of the supporting sleeve respectively; a check pole is arranged in the middle of the upper end of the supporting sleeve; connecting bases and connecting poles snap-on connecting with the check stands and check pole are arranged in the corresponding positions on the inner surface of the housing.

In the aforesaid structure, a push member is arranged at the right end of the push rod; the push member is located at the right end of the housing.

In the aforesaid structure, a guard is arranged above the right end of the housing; the guard has a groove corresponding to the push member.

In the aforesaid structure, the right end of the cap extends into the supporting sleeve; three hooks are evenly arranged on the upper circumference of the right end of said cap; hook holes corresponding to the hooks are arranged in the corresponding positions in the supporting sleeve; the hooks are hooked in the hook holes.

In the aforesaid structure, a plurality of pairs of semi-rings, each pair of semi-rings comprises a round hook-ring and an oblique hook-ring; the round hook-ring and the oblique hook-ring can be engaged.

The benefits of first embodiment disclosed herein are as follows: the automatic cyclic ring binder mechanism has a simple structure, can accomplish the open-closing cycle when being pushed by one hand cyclically through the actions of positioning and locking by automatically revolving push rod positioning bush arranged in the push rod, recoil spring and push members, and be operated comfortably, easily, simply and conveniently, thus reducing the cost of use and meeting the market demand.

The second embodiment described herein is intended to effectively overcome the shortcomings in technology stated above, and provide a single hand-operated binder mechanism that has a simple structure, can be opened or closed with one hand, and be operated comfortably, easily, simply and conveniently, thus reducing the cost of use.

The technical solution of the second embodiment disclosed herein is as follows: it comprises a housing, a pair of pivotable hinge boards inside the housing and clamped tightly by the housing, and a plurality of pairs of semi-rings secured on the pair of hinge boards respectively. The improvement made in it is that it further comprises a drawbar installed inside the housing that can move along the housing longitudinally; the drawbar is located beneath the hinge boards; a draw spring and a plurality of top bars are arranged on the drawbar; the top bars are used for propping up the hinge boards; a push member is arranged at one end of the drawbar; the draw spring connects with the housing; the top bars extend from the hinge boards; a clamping slot matching with the top bars is arranged in the inner surface of the housing; an opening corresponding to the push member is arranged at one end face of the housing; the push member is located at the opening; a ledge horizontally extends from the end face; when the ring binder mechanism is closed, the push member contacts with the ledge.

In the aforesaid structure, each said top bar comprises an integrally formed body of brace, an inclined part and a horizontal part; the bodies of top bars are arranged on the drawbar; the inclined parts are used for propping up the hinge boards; the horizontal parts match with the clamping slot; a plurality of slots are arranged in the hinge boards; the inclined parts and the horizontal parts extend from the slots respectively.

In the aforesaid structure, a button is arranged on one side of the push member and a spring is arranged inside the push member; the button connects with the spring; when the ring binder mechanism is closed, the button contacts with the ledge.

In the aforesaid structure, a guard is arranged on the housing; the side of the guard is level with the inner surface of the opening; when the ring binder mechanism is closed, the push member makes contact with the guard.

In the aforesaid structure, a mounting hole for mounting the ring binder mechanism is arranged near each end of the housing; the length of the drawbar is less than the length from either said mounting hole to the other end; a mounting slot is arranged on the drawbar near the push member; after the ring binder mechanism is mounted, the mounting slot can ensure that the drawbar will move longitudinally along the housing.

In the aforesaid structure, of the plurality of pairs of semi-rings, each pair of semi-rings comprises a round hook-ring and an oblique hook-ring; when the ring binder mechanism is closed, the round hook-ring and the oblique hook-ring are engaged.

The single hand-operated ring binder mechanism disclosed in this embodiment brings about the following beneficial results: to open the ring binder mechanism, use one hand to press the button on the push member, which will result in that the button is separated from the ledge and released; the draw spring returns to the original position; the drawbar is pulled by the draw spring and moves; the horizontal parts of the top bars are separated from the clamping slot; the inclined parts of the top bars prop up the hinge boards; each pair of semi-rings is separated from each other, thus the ring binder mechanism is opened; to close the ring binder mechanism, use one hand to press the button on the push member and push the drawbar to move toward the housing longitudinally; when the push member is at the opening, the button is released, the button makes contact with the ledge, the draw spring is pulled, the top bars are clamped in the clamping slot, the hinge boards return to their original positions, and each pair of semi-rings is engaged, thus the ring binder mechanism is closed. It has a simple structure, can be opened or closed with one hand without requiring high physical strength of the hand, has nice hand feel, and can be operated comfortably, easily, simply and conveniently; particularly, when the ring binder mechanism contains a large number of leaflets. It can be conveniently opened or closed with one hand, thus saving both time and labor, reducing the cost of use and meeting the market demand.

The objective of this invention is to overcome the defects of the technique above and provide a push-tab single-hand binder. Only one hand is required to open or close the binder. It's very pleasant, easy and convenient to handle the binder. It can save a lot of manpower and reduce costs.

In order to achieve this objective, a proposal for this practical invention is shown here: The third embodiment binder comprises a base plate with an opening at the end, a pair of pivoting hinge plates, and several pairs of half-ring elements, wherein a tension rod is installed inside the base plate and movable along the axis direction of the base plate; this tension rod is located below the hinge plates; along the axis direction of the tension rod, there is a tension spring and several top bars for jacking up the hinge plates; the tension spring is connected to the hinge plates; the top bars mentioned above extend from the hinge plates, and the upper end of the top bars snaps into a slot which is located on the top of the base plate's inner surface; a push member is attached to the right side of the tension rod, they are integrated into a whole; this push member is located at the opening of the right side of the base plate; a through chamber is located on the push member; the through chamber is connected to a slot on the tension bar; a spring is on the inner surface of the through chamber; a connecting rod is inside the spring; the upper end of the connecting rod is connected to a push button; the upper end of the push button extends from the through chamber and is fixed on the upper end of the tension rod baffle; the lower end of the push button touches the upper end of the spring; the lower end of the connecting rod is connected to a fixed block; a movable connecting rod is attached to the fixed block; the movable connecting rod is set tilted upward and located inside the slot; a notch and a sloping block are located at the upper surface of the movable connecting rod; the notch is close to the left side of the movable connecting rod; the notch matches the ridges on the tension rod; the sloping block corresponds to a breach or recess on the base plate's surface at the right end; the height of the recess is less than the height of the sloping block; the right end of the sloping block (ledge) leans against the inner surface of the base plate on the right end.

As discussed herein, the top bar is comprised of a one-piece top bar body, an inclined part and a horizontal part; the top bar body is located on the tension rod; one end of the inclined part is connected to the top bar body, the other end is connected to the horizontal part; the inclined and horizontal parts extend from the hinge plates, the horizontal part snaps into the slot on the inner surface of the base plate's upper end.

As discussed herein, the through chamber located on the tension rod baffle consists of a push button chamber, spring chamber, connecting rod chamber, and fixed block chamber from top to bottom; the step stair is formed by the push button chamber and the spring chamber; the second step is formed by the spring chamber and the connecting rod chamber; the third step is formed by the connecting rod chamber and the fixed block chamber; the fixed block chamber is connected to the slot on the tension rod; a spring is located on the inner side face of the spring chamber; the lower end of the spring leans against the second stair, the upper end of the spring is located inside the push button chamber; a connecting rod is placed through the inside of the spring; the upper end of the connecting rod is located inside of the push button chamber; the upper end of the connecting rod connects to a push button; the shape of the push button corresponds to the push button chamber; the upper end of the push button extends out from the button chamber and is located at the top section of the tension rod baffle; the lower end of the push button is connected to the upper end of the spring; when the push button is pressed, the lower end of the push button leans against the first stair; the lower end of the connecting rod is located inside the connecting rod chamber and connects to a fixed block; the fixed block is located inside the fixed block chamber; the shape of the fixed block corresponds to the fixed block chamber; the upper end of the fixed block leans against the third stair.

As discussed herein, the guard and the upper end of the base plate are integrated into a whole; the right end surface of the push member and the right end surface of the base plate are at the same level.

As discussed herein, a mounting hole is located on the base plate, near the left side and the right side of the base plate respectively; a positioning tube is formed on the mounting hole; the positioning tube that is close to the right side of the base plate goes through the slot on the tension rod, and the shape of the left side of the slot matches the positioning tube; the lower end of the positioning tube and the lower end of the base plate are at the same level. As discussed herein, a hand rest is formed on the right end surface of the tension rod baffle.

This practical invention has the advantages that: the invention relates to a push-tab single-hand binder, wherein when the binder needs to be opened, use one hand to press the push button; the spring is compressed, the connecting rod and the fixed block move downward along with the pressing of the push button; the moving of the fixed block drives the movement of the right end of the movable connecting rod downward, causing the sloping block's detachment from the right side surface of the base plate; when the right end of the sloping block is located at the recess on the right surface of the base plate, the tension spring returns, driving the movement of the tension rod toward the right; the horizontal part of the top bar detaches from the slot; the inclined part of the top bar jacks up the hinge plate; every pair of the half-ring elements are separated, and the binder is open. When the binder needs to be closed, use one hand to push the push member toward the left; the tension rod moves toward the left; the spring is extended gradually; the sloping block is pressed by the recess while it's going through the recess that is on the right end surface of the base plate, causing the right end of the movable connecting rod to move downward gradually; this also drives the fixed block, the connecting rod and the push button to move downward gradually; the spring is compressed gradually; the spring returns when the sloping block goes through the breach, driving the push button, the connecting rod and the fixed block to move upward; the movement of the fixed block drives the right end of the movable connecting rod to move upward; the right end of the sloping block leans against the right end inner surface of the base plate; the spring is extended fully; the horizontal part of the top bar snaps into the slot; the inclined part of the top bar has no force with the hinge plate; the hinge plate returns; every pair of the half-ring elements are closed, and the binder is closed. This practical invention has a simple structure. One hand is required to open or close it. Manpower is not required. It can be opened easily with little strength. It is easy on the hands. It's very comfortable, easy and convenient to handle the binder. Using one hand to open or close the binder is very convenient, especially when excessive amounts of papers are added. It's time and effort saving. It has long service duration and reduces cost. It meets consumers' demand greatly. It will be appreciated that although the embodiments discussed herein can be opened with one hand, this is not a limitation on the present invention and two hands can be used.

Chinese Patent No. ZL 201420208154.5, filed on Apr. 25, 2014 (Published as CN 2038320242 U on Sep. 17, 2014), Chinese Patent No. ZL 2014 2 0071212.4, filed on Feb. 19, 2014 (Published as CN 203832041 U on Sep. 17, 2014), and Chinese Application No. 201520007859.5, filed on Jan. 7, 2015, the entireties of which are incorporated by reference herein, teach ring binder mechanisms.

The invention, together with additional features and advantages thereof, may be best understood by reference to the following description.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
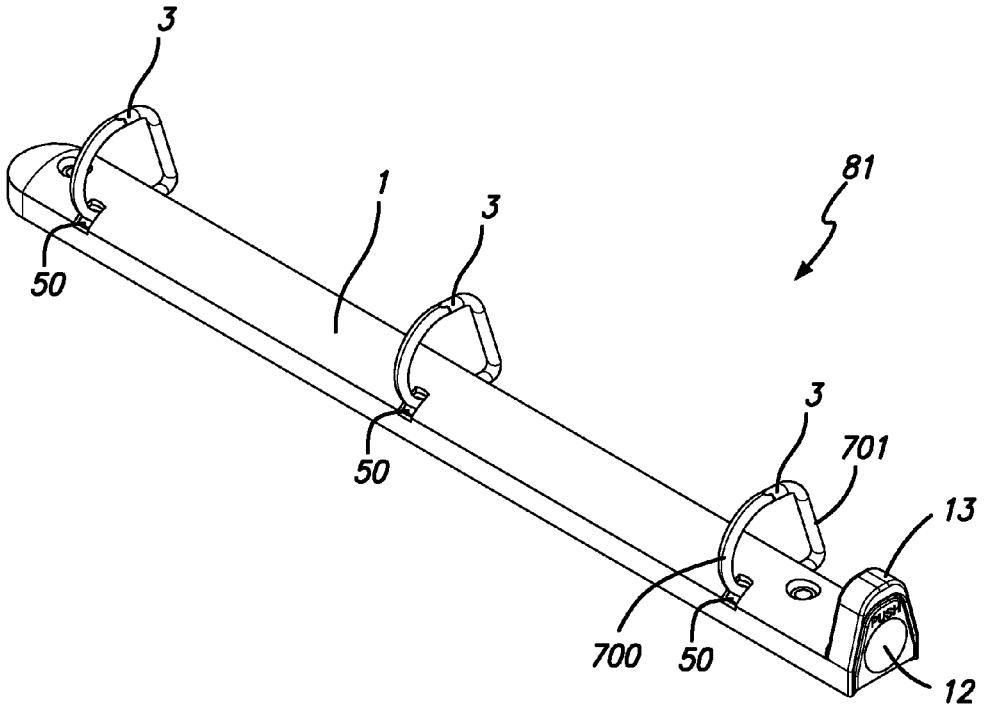
FIG. 1 is a perspective view of a first embodiment of a ring binder mechanism that is an automatic cyclic ring binder mechanism in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or another embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "right," "left" and "below" used herein are merely for ease of description and refer to the orientation of the components as shown in the figures. It should be understood that any orientation of the components described herein is within the scope of the present invention.

With reference to FIGS. 1-8B, the automatic cyclic ring binder mechanism 81 comprises a housing 1, a pair of pivotable hinge boards 2 inside the housing 1 and clamped tightly by the housing 1, and a plurality of pairs of semi-rings 3 secured on the hinge boards 2 respectively; the semi-rings 3 protrude through openings 50 in the upper surface of the housing 1. Specifically, there are three pairs of semi-rings 3. As shown in FIG. 1, each pair of semi-rings 3 comprises a round hook-ring 700 and an oblique hook-ring 701. The round hook-ring 700 and the oblique hook-ring 701 can be engaged. The round hook-ring 700 facilitates flipping leaflets, while the oblique hook-ring 701 facilitates collecting and securing leaflets.

Figure 2:
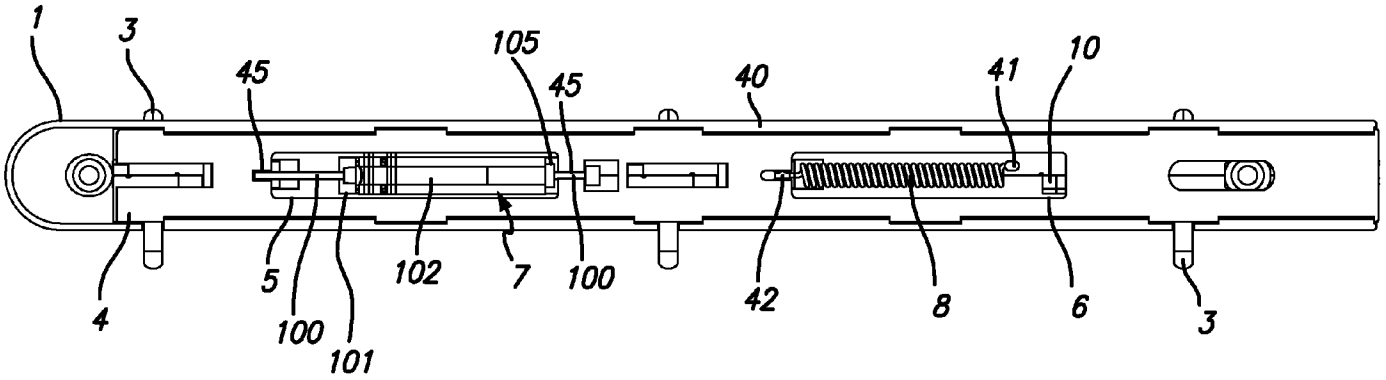
FIG. 2 is a bottom view of the ring binder mechanism of FIG. 1.
Figure 3:
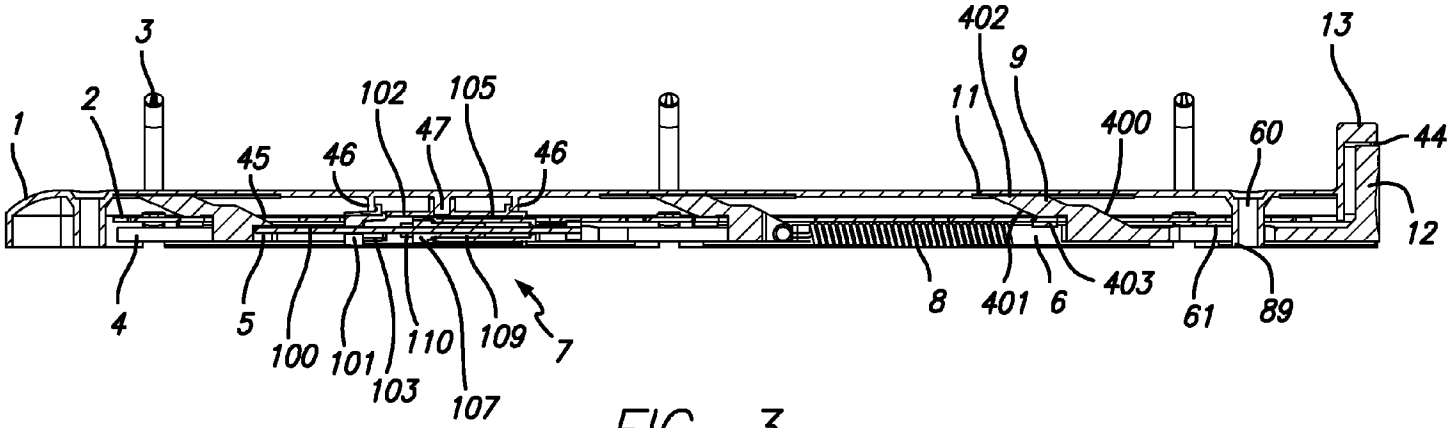
FIG. 3 is a sectional view of the ring binder mechanism of FIG. 1.
Figure 4:
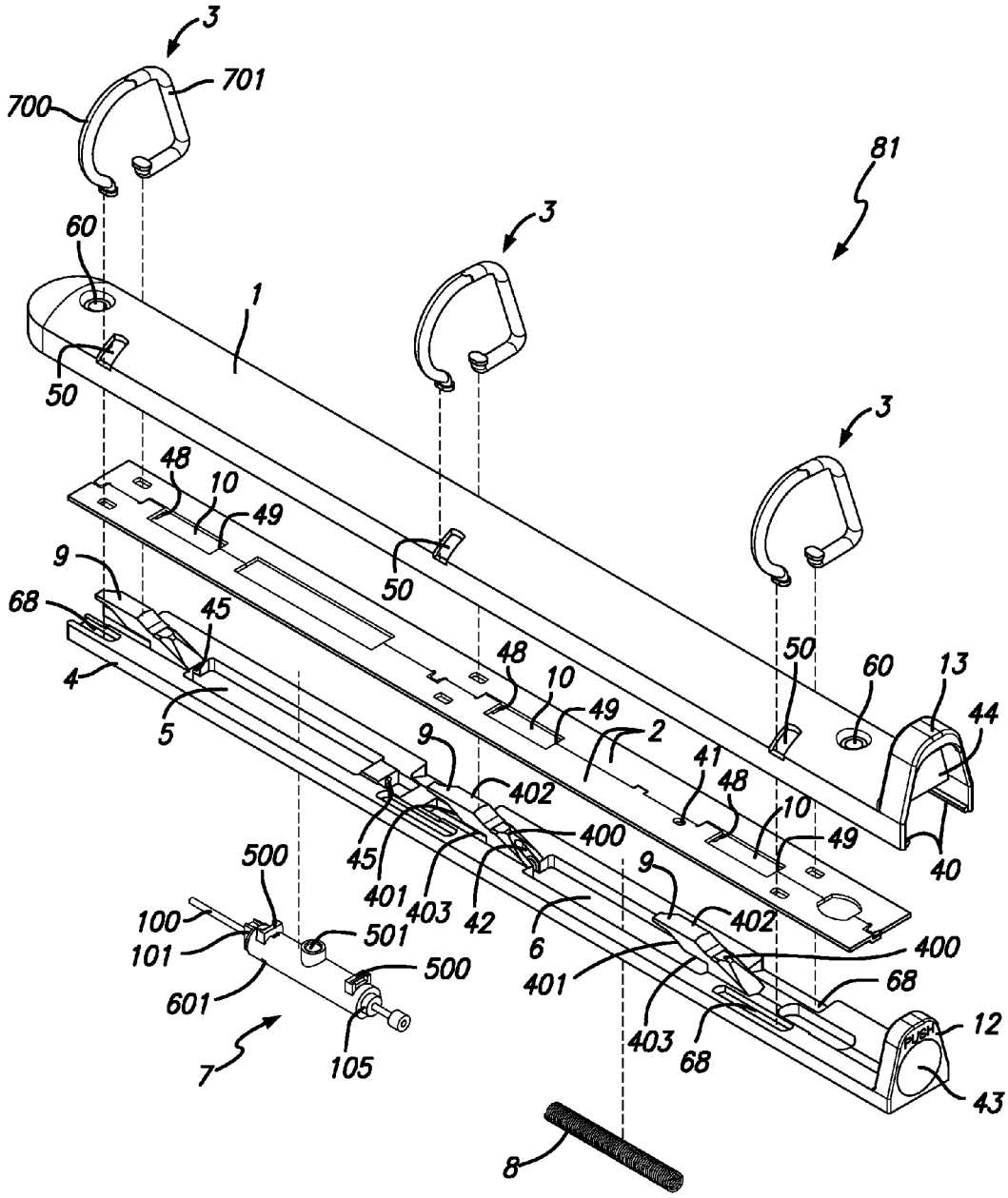
FIG. 4 is an exploded perspective view of the ring binder mechanism of FIG. 1.

With reference to FIGS. 2-4, the automatic cyclic ring binder mechanism 81 further comprises a travel bar or push rod 4 inside the housing 1 that can move along the axis of the housing 1. Specifically, a rail 40 extends inward from each side of the bottom of the housing 1; the push rod 4 moves inside the rails 40 along the axis of the housing 1. The push rod 4 moves easily and conveniently. In a preferred embodiment, the push rod 4 is located beneath the hinge boards 2. A first straight slot 5 and a second straight slot 6 are arranged in the push rod 4 from left to right (as viewed in the figures) along the axis of the housing 1. An automatically revolving push rod positioning bush 7 (also referred to herein as an opening assembly) is arranged inside the first straight slot 5, which can position and lock the push rod 4. The upper end of the automatically revolving push rod positioning bush 7 securely connects with the inner surface of the housing 1 (by what).

In a preferred embodiment, a recoil spring 8 is arranged inside the second straight slot 6, which can drive the push rod 4 to move inside the housing 1. The recoil spring 8 connects with the hinge boards 2 at an opening 41. The connection location between the recoil spring 8 and the hinge boards 2 is close to the right end of the second straight slot 6. The opposite end of the recoil spring 8 is connected to the push rod 4 at an opening 42. A plurality of top bars 9 are arranged on the upper end of the push rod 4. The number of the top bars 9 is preferably equal to the number of pairs of the semi-rings 3. However, this is not a limitation and there may be more or less push members. The top bars 9 are located beneath the semi-rings 3. A straight slot 10 is arranged in the hinge boards 2 in the position corresponding to that of the top bars 9. The top bars 9 pass through the straight slot 10.

As shown in FIGS. 3-4, the top bars 9 each include an inclined opening surface or binder-opening face 400, an inclined closing surface or binder-closing face 401, a top surface 402 and a blocking surface 403 formed integrally are arranged on the top bars 9. A recessed slot or clamping slot 11 (for each top bar 9) that receives the top surface 402 of the top bar 9 is arranged in the inner surface of the housing 1. A push member 12 is arranged at the right end of the push rod 4. The push member 12 is located at the right end of the housing 1. A place for a user to place their finger or hand 43 is arranged on the push member 12, to facilitate pushing the push rod 4 by hand. A guard 13 is arranged above the right end of the housing 1. The guard 13 has a groove 44 corresponding to the push member 12, to facilitate pressing the push member 12 by hand. In a preferred embodiment, the push rod 4 includes clearance openings 68 therein that provide clearance for the bottom of the hook-rings (70 and 71) to pivot and translate. The automatic cyclic ring binder mechanism 81 is very beautiful and practical.

Figure 7:
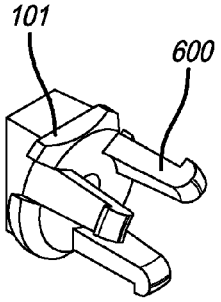
FIG. 7 is a schematic drawing of the structure of the supporting sleeve of the ring binder mechanism of FIG. 1.
Figure 8:
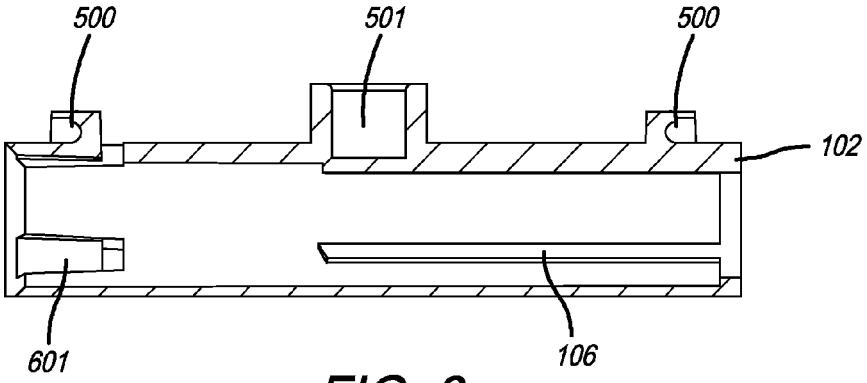
FIG. 8 is a schematic drawing of the structure of the cap of the ring binder mechanism of FIG. 1.

Further, the automatically revolving push rod positioning bush 7 comprises a connecting rod 100, a cap 101 covering the connecting rod 100, a supporting sleeve 102, a compression spring 103 inside the supporting sleeve 102, a turntable sheath 104, and a slide claw sheath 105. The left end of the connecting rod 100 connects with the left end of the first straight slot 5 in a receiving groove 45, and the right end of the connecting rod 100 connects with the right end of the first straight slot 5 in a receiving groove 45. Referring to FIG. 8, check stands 500 are arranged at the left side and the right side of the upper end of the supporting sleeve 102 respectively. A check pole 501 is arranged in the middle of the upper end of the supporting sleeve 102. Connecting bases 46 and a connecting pole 47 corresponding to the check stands 500 and check pole 501 are arranged in corresponding positions on the inner surface of the housing 1, to facilitate installation of the supporting sleeve. They are connected securely, to prevent the supporting sleeve 102 from moving along with the movement of the connecting rod 100. The left end of the supporting sleeve 102 securely connects with the cap 101; specifically, the right end of the cap 101 extends into the supporting sleeve 102. Referring to FIG. 7, three hooks 600 are evenly arranged on the upper circumference of the right end of the cap 101; hook holes 601 corresponding to the hooks 600 are arranged in the corresponding positions in the supporting sleeve 102. The hooks 600 are hooked in the hook holes 601. They are connected securely, to prevent the cap 101 from moving along with the movement of the connecting rod 100. Three bosses 106 parallel with the axis of the supporting sleeve 102 are evenly distributed on the inner wall of the right end of the supporting sleeve 102. The right end of the turntable sheath 104 extends into the slide claw sheath 105. The right end of the slide claw sheath 105 is close to the right end of the first straight slot 5. A turntable 107 and a slide claw 108 are arranged at the left end of the turntable sheath 104 and the left end of the slide claw sheath 105 respectively. A groove 109 corresponding to the bosses 106 is arranged at the outer circumference of the turntable 107 and of the slide claw 108 respectively. The turntable sheath 104 and the slide claw sheath 105 can move along the bosses 106 inside the supporting sleeve 102 via the grooves 109. The slide claw sheath 105 can drive the turntable sheath 104 to move and revolve. A link block 110 is arranged on the connecting rod 100.

The link block 110 is close to the left end of the turntable sheath 104, and can stop the movement of the turntable sheath 104. One end of the compression spring 103 connects with the cap 101, and the other end connects with the link block 110.

Figure 5:
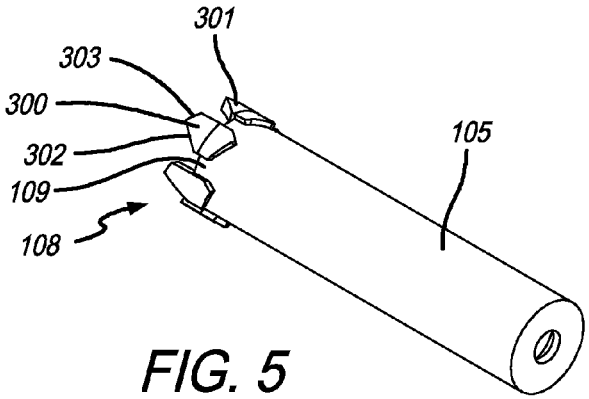
FIG. 5 is a schematic drawing of the structure of the slide claw sheath of the ring binder mechanism of FIG. 1.
Figure 6:
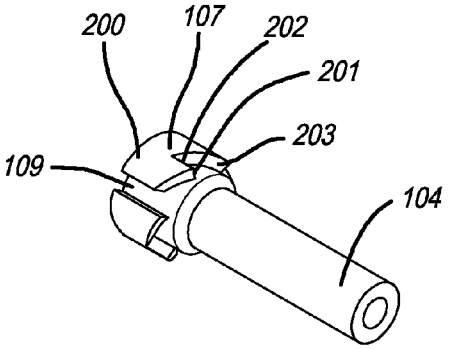
FIG. 6 is a schematic drawing of the structure of the turntable sheath of the ring binder mechanism of FIG. 1.

With reference further to FIGS. 5-6, the groove 109 divides the outer circumference of the turntable 107 into three turntable lugs 200 of the same size; an inclined cambered face 201, a vertical straight face 202 and an inclined straight face 203 are arranged in order on the right ends of the turntable lugs 200. The inclined cambered face 201 and the inclined straight face 203 have the same direction of inclination. The left ends of the bosses 106 correspond to the vertical straight face 202. The groove 109 divides the outer circumference of the slide claw 108 into three pairs of slide claw lugs of the same size. Each pair of the slide claw lugs comprises a first lug 300 and a second lug 301 separated from each other. The first lug 300 and the second lug 301 are of the same size and arranged side by side. The left ends of the first lug 300 and the second lug 301 have a first inclined face 302 and a second inclined face 303 respectively. There's an angle contained by the first inclined face 302 and the second inclined face 303. The first inclined face 302 corresponds to the inclined cambered face 201, and the second inclined face 303 corresponds to the inclined straight face 203. When the first inclined face 302 on the first lug 300 presses the inclined cambered face 201, and the second inclined face 303 on the second lug 301 presses the inclined straight face 203, the turntable sheath 104 revolves, the first lug 300 is wedged in the groove 109 on the turntable 107, and the left ends of the bosses 106 contact with the inclined straight face 203.

Figure 8A:
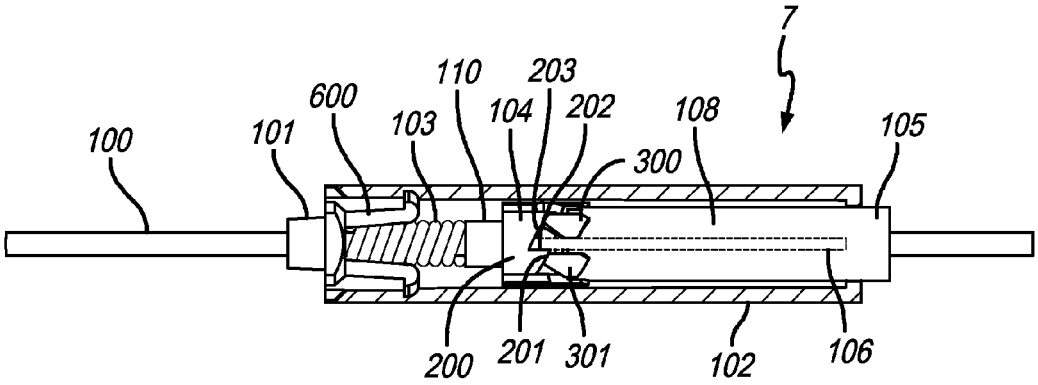
FIG. 8A is a plan view of the opening assembly in the closed position showing a portion of the supporting sleeve in section and one of the bosses in hidden lines.

The binder-closing mechanism through the application of the aforesaid structure, as is shown in FIG. 8A, is as follows: use one hand to press the push member 12 and the push rod 4 toward the left end of the housing 1. The push rod drives the top bars 9 and the connecting rod 100 to move. The recoil spring 8 is pulled or stretched. The inclined closing surface 401 pushes against or contacts a closing edge 48 (which is an edge of straight slot 10), which pushes the hinge boards 2 downward. The right end of the first straight slot 5 pushes against and drives the slide claw sheath 105 to move. The slide claw sheath 105 then drives the turntable sheath 104 to move. The compression spring 103 (within supporting sleeve 102) is compressed. The front end of the top surface 402 is wedged in to (or moves within) the clamping slot 11. When this happens the second inclined face 303 on the second lug 301 presses the inclined straight face 203, the turntable sheath 104 revolves, the first lug 300 is wedged in the groove 109 of the turntable 107, and the left ends of the bosses 106 contact with the inclined straight face 203. When the hand is lifted up, the turntable sheath 104 revolves, the left ends of the bosses 106 press the inclined straight face 203, the sides of the bosses 106 press the vertical straight face 202, thus accomplishing the locking action. As a result, the round hook-rings 700 and the oblique hook-rings 701 are engaged, thus accomplishing the binder-closing action. The action of the push rod positioning bush 7 is similar to that of a pen. For example see U.S. Pat. Nos. 3,288,115, 3,652,173 and 3,819,282, the entireties of which are incorporated herein by reference.

Figure 8B:
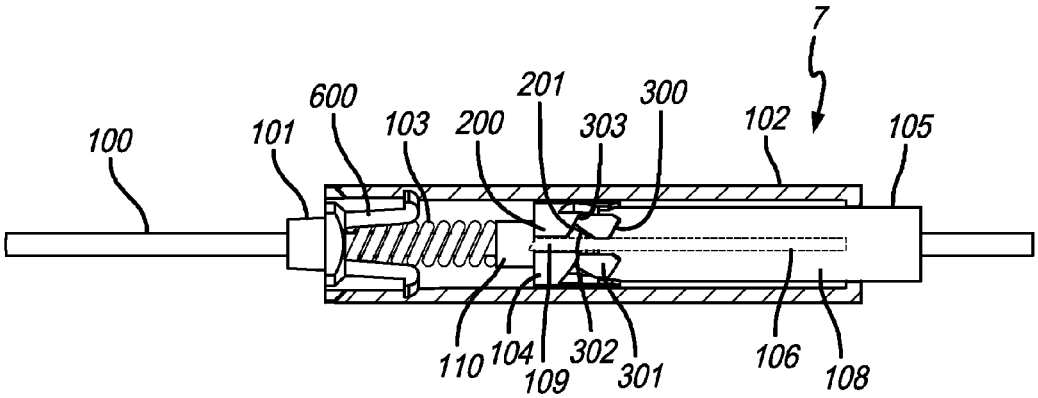
FIG. 8B is a plan view of the opening assembly in the open position showing a portion of the supporting sleeve in section and one of the bosses in hidden lines.

The binder-opening mechanism, as is shown in FIG. 8B, is as follows: Press the push member 12 and push rod 4 toward the left end of the housing 1. The first lug 300 and the second lug 301 press the turntable lug 200, and the turntable sheath 104 revolves. The bosses 106 are wedged in the groove 109 on the turntable 107 and the turntable sheath 104 and the slide claw sheath 105 move toward the right end of the housing 1 along the bosses 106, thus accomplishing the unlocking action. The compression spring 103 returns to the original position, driving the push rod 4 to move toward the left end of the housing 1. The push rod 4 drives the top bars 9 to move. The front end of the top surface 402 of the top bar 9 separates from the end of the clamping slot 11. The inclined opening surface 400 pushes on or contacts an opening edge 49 (which is an edge of straight slot 10), which pushes the hinge boards 2 upwardly, and a portion of the top bar 9 withdraws from the straight slot 10. The recoil spring 8 returns to the original position (the recoil spring 8 is what pulls the travel bar 4 to the right). When the hinge boards 2 move upwardly, the round hook-rings separate from the oblique hook-rings 701, thus accomplishing the binder-opening action. The present invention has a simple structure, can accomplish the open-closing cycle when the push rod 4 is pushed by one hand cyclically, and be operated comfortably, easily, simply and conveniently, thus reducing the cost of use and meeting the market demand.

With reference to FIGS. 9-12, a second embodiment of a ring binder mechanism 82, referred to herein as a single hand-operated ring binder mechanism 82 is disclosed. The ring binder mechanism 82 includes a housing 1, a pair of pivotable hinge boards 2 inside the housing 1, and a plurality of pairs of semi-rings 3 secured on the pair of hinge boards 2 respectively. The single hand-operated ring binder mechanism 82 may include two or three pairs (or more) of semi-rings 3. The ring binder mechanism 82 further comprises a travel bar or drawbar 4 installed inside the housing 1 that can move along the housing 1 longitudinally. The drawbar 4 is located beneath the hinge boards 2. A plurality of top bars 9 are arranged on the drawbar 4, which are used for propping up (and pushing down) the hinge boards 2. The top bars 9 are arranged along the longitudinal axis of the drawbar 4. The number of top bars 9 is preferably equal to the number of pairs of the semi-rings 3. However, this is not a limitation and there may be as few as one top bar 9. The top bars 9 extend through straight slots 10 in the hinge boards 2. A clamping slot 11 matching with the top bars 9 is arranged in the inner surface of the housing 1. A push member 12 is arranged at one end of the drawbar 4. A draw spring 8 is arranged near the other end of the drawbar 4. The draw spring 8 connects between the drawbar 4 (in opening 42) and one of the hinge boards 2 (in opening 41). An opening that receives the push member 12 (and button 57) is arranged at one end face of the housing 1 and defined between two extension members 53. The push member 12 is located at the opening 51. The drawbar 4 can move away from the opening 51. A ledge 54 horizontally extends inwardly from an inner surface of one of the extension members 53. When the ring binder mechanism is closed, the push member 12 makes contact with and is held in the closed position by the ledge 54.

Figure 11:
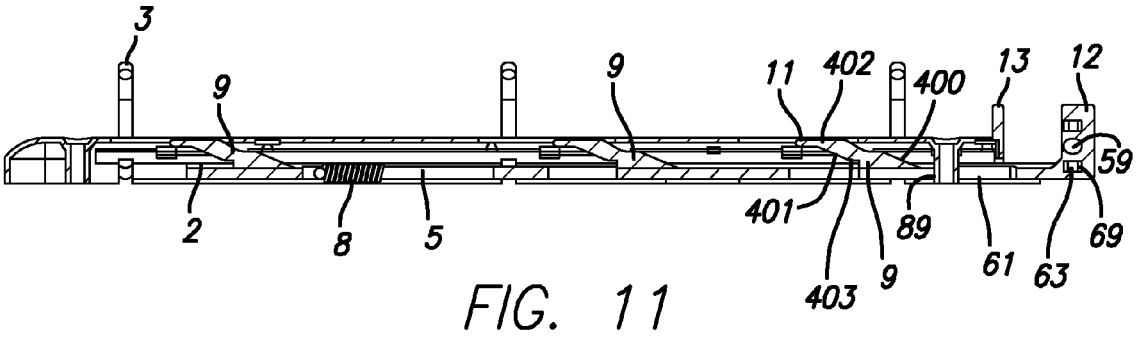
FIG. 11 is a sectional view of the ring binder mechanism of FIG. 9 in the open position.
Figure 12:
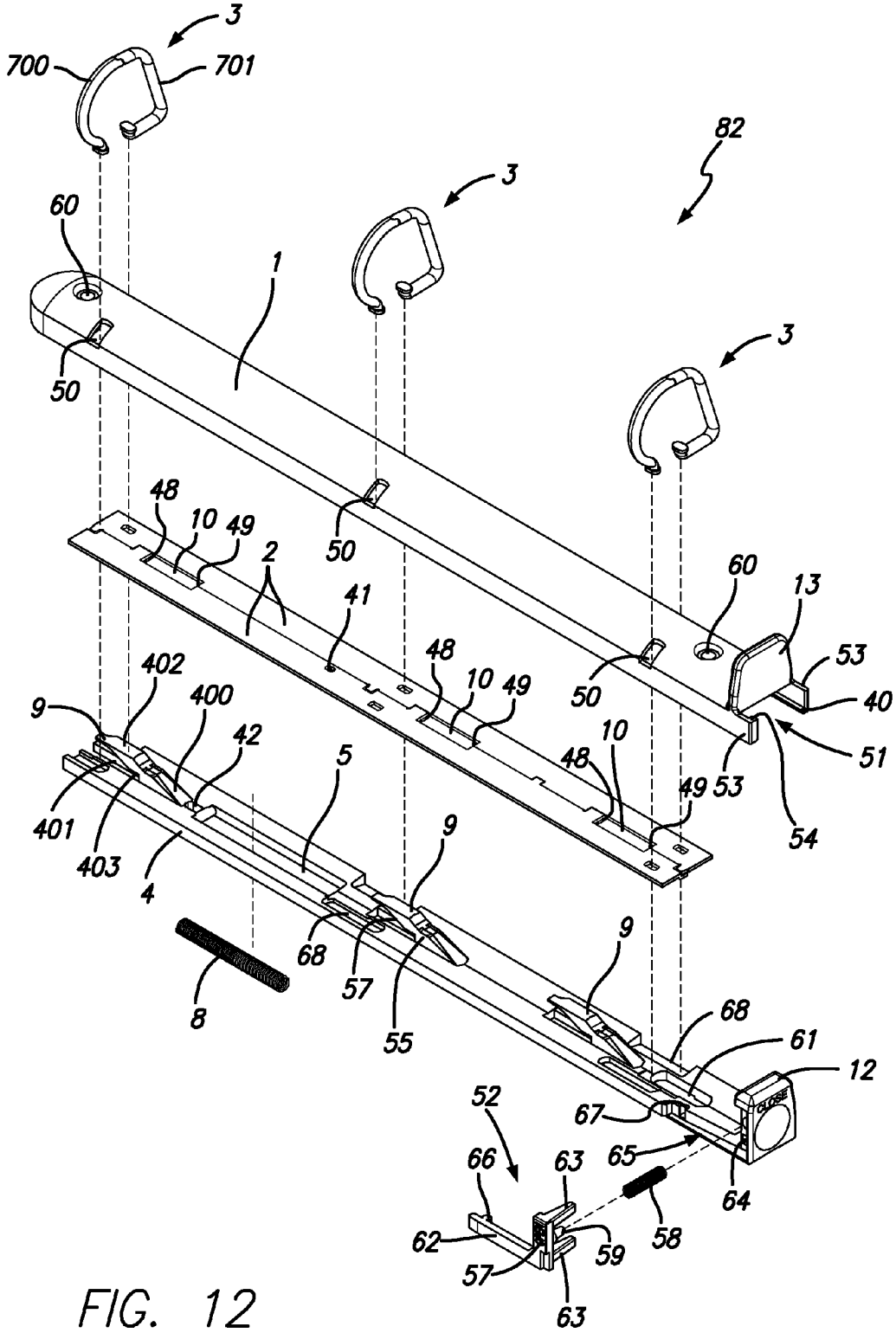
FIG. 12 is an exploded perspective view of the ring binder mechanism of FIG. 9.

As shown in FIGS. 11-12, specifically, each top bar 9 comprises an integrally formed body with the drawbar 4 that includes an inclined part 55 and a horizontal part 56 and inclined opening surface 400, inclined closing surface 401, top surface 402 and blocking surface 403. Referring to FIG. 12, the bodies of top bars 9 are arranged on the drawbar 4, the inclined parts 55 (including inclined opening surface 400 and inclined closing surface 401) are used for propping up (and pushing down) the hinge boards 2. the horizontal parts 56 (and top surface 402) match with the clamping slot 11. A plurality of straight slots 10 are arranged in the hinge boards 2. Preferably, the number of the straight slots 10 is equal to the number of top bars 9. The inclined parts 55 and the horizontal parts 56 extend through the slots 10.

Figure 9:
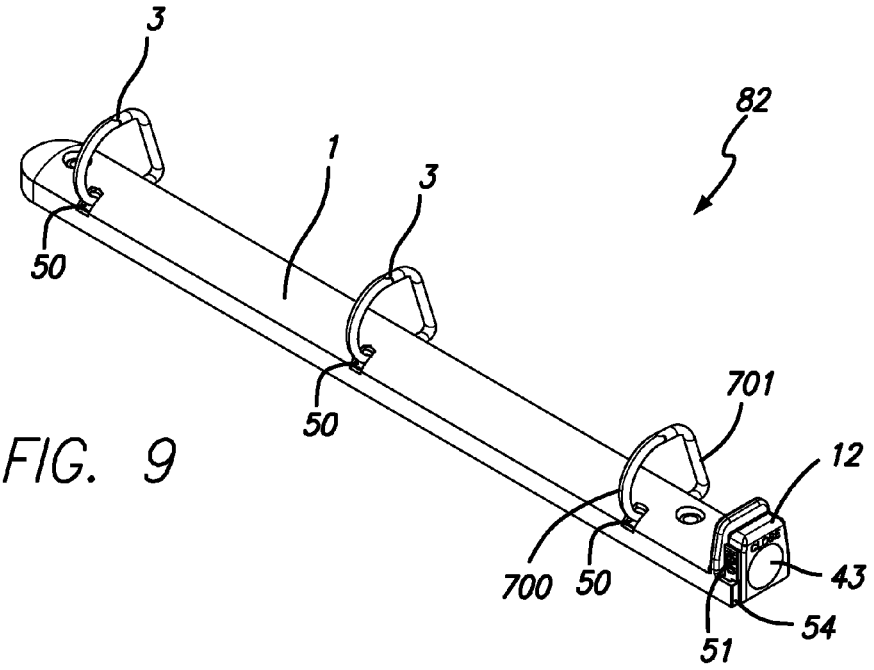
FIG. 9 is a perspective view of a second embodiment of a ring binder mechanism that is a single hand-operated ring binder mechanism in accordance with a preferred embodiment of the present invention.
Figure 10:
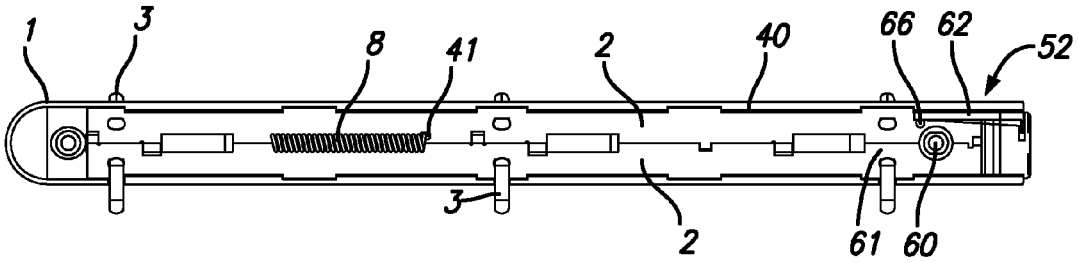
FIG. 10 is a bottom view of the ring binder mechanism of FIG. 9 in the closed position with the travel bar/drawbar omitted.

Further, a button 57 is arranged on one side of the push member 12. The button 57 is preferably made of environmentally friendly plastic material, so as to improve hand feel and ensure comfortable and easy operation. A spring 58 is arranged on the inside of the push member 12 and is preferably positioned on a spring projection 59. The spring 58 biases the button 57 outwardly so that when the ring binder mechanism is in the closed position, the button 57 contacts and is positioned against the ledge 54, as shown in FIG. 9.

As shown in FIG. 12, in a preferred embodiment, the button 57 includes an extension 62 that is hingedly connected (e.g., by a hinge post 66 and corresponding notch 67) to the drawbar 4 and is positioned in an angled cut out 65. The portion of the extension 62 near the button 57 is spaced from the drawbar 4 (as a result of the angle in the angled cut out 65). This allows the button 57 to move inwardly (to clear the ledge 54, as described below) and is then biased back outwardly by the spring 58. In a preferred embodiment, the button 57 includes two positioning projections 63 that extend inwardly (transversely) into openings 64 the push member 12.

Further, a guard 13 is arranged on the housing 1. Referring to FIG. 12, the side of the guard 13 is level with the inner surface of the opening 51, and the width of the guard 13 is about equal to the width of the housing 1. When the ring binder mechanism is closed, the push member 12 contacts with or is positioned close to the guard 13, which can prevent the shift or deformation of the push member 12.

Further, a mounting hole 60 for mounting the ring binder mechanism 82 is arranged near each end of the housing 1. The ring binder mechanism is preferably secured by rivets or the like through the mounting holes 60. The length of the drawbar 4 is preferably less than the length from either mounting hole 60 to the other end. A positioning slot 61 is arranged on the drawbar 4 near the push member 12. After the ring binder mechanism is mounted, the positioning slot 61 can ensure that the drawbar 4 will move longitudinally along the housing 1.

Further, of a plurality of pairs of semi-rings 3, each pair of semi-rings 3 comprises a round hook-ring 70 and an oblique hook-ring 71 (however, two round hook-rings can also work). When the ring binder mechanism is closed, the round hook-ring 70 and the oblique hook-ring 71 are engaged. The round hook-rings 70 and the button 57 are preferably on the same side (however it can be reversed). The round hook-rings 70 facilitate flipping leaflets, while the oblique hook-rings 71 facilitate securing and collecting leaflets.

To open the single hand-operated ring binder mechanism 82 disclosed herein, a user uses one hand to press the button 57 on the push member 12, which will result in that the button 57 is separated from (or clears) the ledge 54 and is then released. The draw spring 58 returns to the original position. The drawbar 4 is pulled by the draw spring 8 and moves. The horizontal parts 56 of the top bars 9 are separated from (or move within) the clamping slot 11 and the inclined parts 55 of the top bars 9 prop up the hinge boards 2 (pivots the hinge boards to the open position). In other words, the inclined opening surface 400 pushes on or contacts the opening edge 49 of straight slot 10, which pushes the hinge boards 2 upwardly. The round hook-ring 70 and the oblique hook-ring 71 on each pair of semi-rings 3 are separated from each other and moved to the open position.

To close the ring binder mechanism 82, a user uses one hand to press the button 57 on the push member 12, which pushes the drawbar 4 to move toward the housing 1 longitudinally. When the push member 12 is at the opening 51, the button 57 is released and is caught or hooked behind the ledge 54 as a result of the biasing action of draw spring 58. The top bars 9 are clamped in the clamping slot 11 (or move thereal-ong). The hinge boards 2 return to the closed position. In other words, the inclined closing surface 401 pushes against or contacts a closing edge 48 of straight slot 10, which pushes the hinge boards 2 downward. As a result, the round hook-ring 70 and the oblique hook-ring 71 on each pair of semi-rings 3 are engaged, thus the ring binder mechanism is closed. Put simply, the button 57 is pushed inwardly (transversely) to open the ring binder mechanism 82 and the push member 12 is pushed longitudinally to close the ring binder mechanism 82.

It will be appreciated that the present invention has a simple structure, can be opened or closed by one hand without requiring high physical strength of the hand, has a nice hand feel, and can be operated comfortably, easily, simply and conveniently; particularly when the ring binder mechanism contains a large number of leaflets. It can be conveniently opened or closed with one hand, thus saving both time and labor, reducing the cost of use and meeting the market demand.

Figure 13:
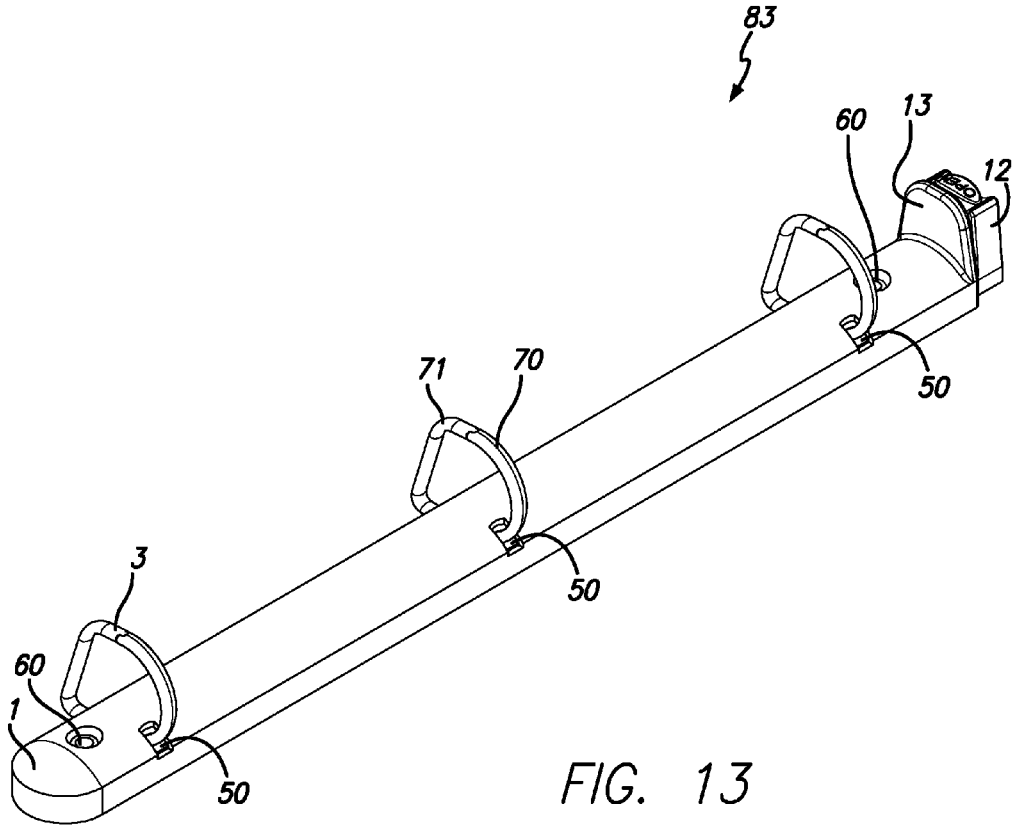
FIG. 13 is a perspective view of a third embodiment of a ring binder mechanism that is a push-tab single-hand binder in accordance with a preferred embodiment of the present invention.
Figure 14:
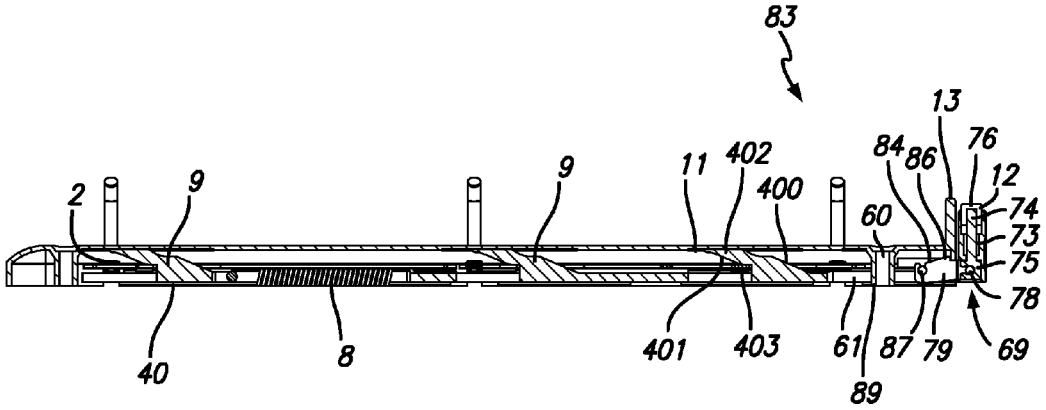
FIG. 14 is a sectional view of the ring binder mechanism of FIG. 13.
Figure 15:
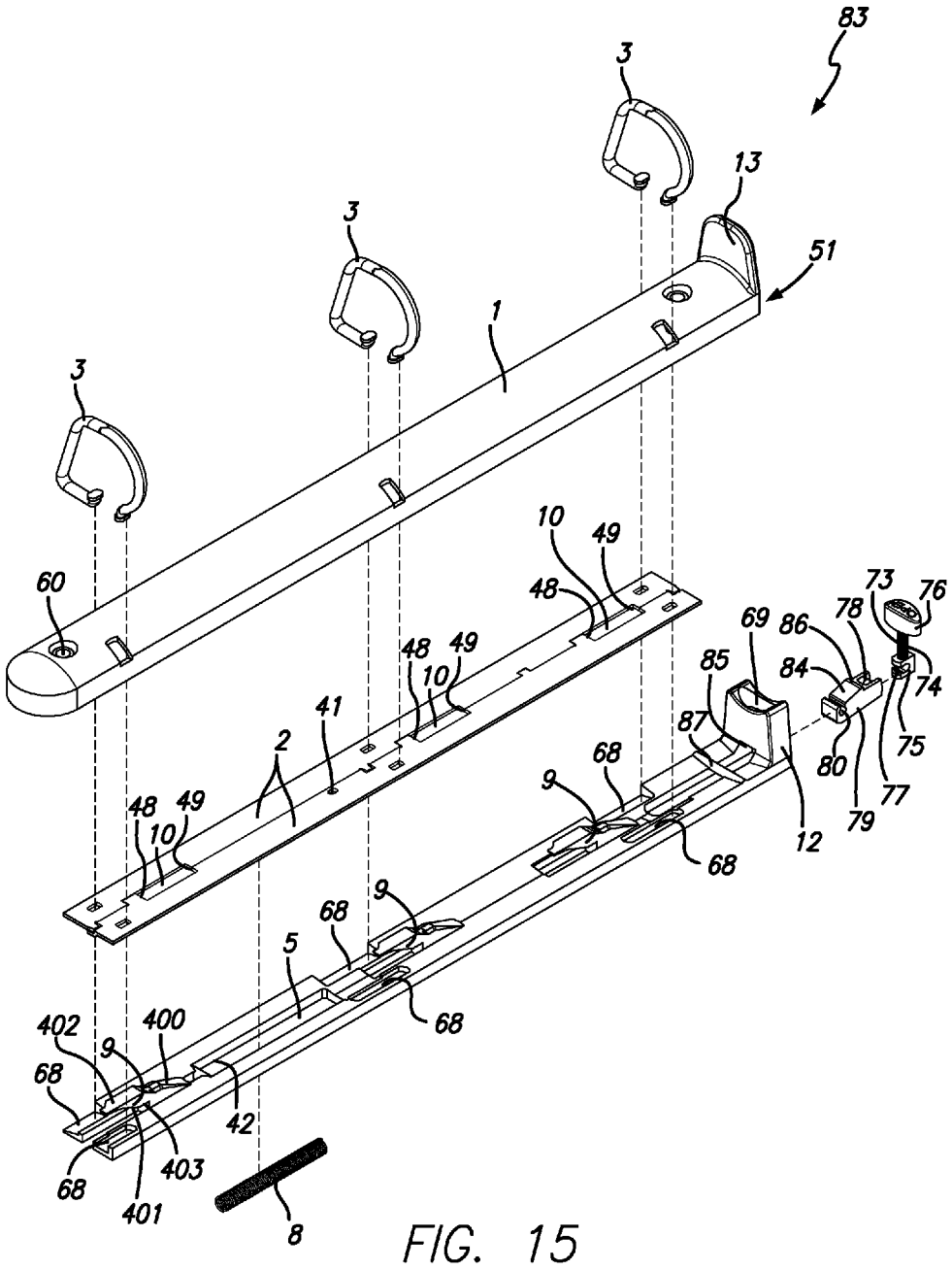
FIG. 15 is an exploded perspective view of the ring binder mechanism of FIG. 13.

FIGS. 13-15 show a third embodiment of a ring binder mechanism 83, referred to herein as push-tab single-hand ring binder mechanism 83. The ring binder mechanism 83 includes a housing or base plate 1 with an opening 51 at the end, a pair of pivoting hinge plates or boards 2 which are located inside the base plate 1 base plate 1, and several pairs of half-ring elements 3 which are fixed on the hinge plates 2 respectively. The half-ring elements 3 can be two or three pairs. In this embodiment, there are three pairs of half-ring elements 3. Each half-ring element 3 is comprised of a round-hook ring half 70 and an oblique-hook ring half 71. When the binder is closed, two ring halves mesh with each other; the round-hook ring half favors flipping paper, and the oblique-hook ring half favors collecting and keeping papers in order.

A travel bar or tension rod 4 is also included and installed inside the base plate 1. The tension rod 4 can move along the axis direction of the base plate 1. The tension rod 4 is located below the hinge plates 2. Along the axis direction of the tension rod 4 there is a tension spring 8 and several top bars 9 for pivoting the hinge plates 2 between the open and closed positions. The number of top bars 9 is preferably the same as the number of the half-ring elements 3. However, this is not a limitation. In this embodiment, the number of the top bars 9 is three. The tension spring 8 is connected between the hinge plates 2 (at opening 41) and the tension rod 4 (at opening 42). The top bars 9 extend through slots 10 in the hinge plates 2, and the top surface 402 of the top bars 9 snap into a slot 11 on the inner surface of the base plate 1. A push member 12 is attached to or integral with the right side of the tension rod 4. The push member 12 is located at the opening 51 of the right side of the base plate 1. A through chamber 69 is located on the push member 12 and is in communication with the slot 61 on the tension rod 4. A connecting rod 74 is positioned in the chamber 69 and includes a fixed block 75 on the lower end thereof. A spring 73 is positioned on the connecting rod 74. The upper end of the connecting rod 74 receives a push button 76 that is movable thereon. The upper end of the push button 76 extends from the through chamber 69 and is arranged on the upper end of push member 12. The lower end of the push button 76 touches the upper end of the spring 73. The lower end of the connecting rod 74 includes the fixed block 75, which includes a notch 77 therein for receiving a hinge post 78 of a movable connecting rod 79. As shown in FIG. 14, the movable connecting rod 79 is positioned such that it is tilted upward and located inside the slot 61. A notch 80 and a sloping block or surface 84 are located at the upper surface of the movable connecting rod 79. The notch 80 is close to the left side of the movable connecting rod 79. The notch 80 matches or receives a ridge 87 on the tension rod 4. The sloping block 84 corresponds to a recess 85 on the base plate's surface at the right end. The height of the recess 85 is preferably less than the height of the sloping block 84. In the closed position, the right side of the sloping block 84 includes a ledge 86 that abuts the inner surface of the base plate 1 on the right end.

Moreover, the top bar 9 is comprised of a one-piece body, an inclined part 55 and a horizontal part 56. The top bar 9 is located on the tension rod 4. One end of the inclined part 55 is connected to the top bar 9 and the other end is connected to the horizontal part 56. The inclined part 55 and horizontal part 56 extend through the hinge plates 2. The horizontal part 56 snaps into the slot 11 on the inner surface of the base plate 1's upper end.

Furthermore, as shown in FIG. 15, the through chamber 69 located on the tension push member 12 consists of a push button chamber, spring chamber, connecting rod chamber, and fixed block chamber from top to bottom. A first step is formed by the push button chamber and the spring chamber. A second step is formed by the spring chamber and the connecting rod chamber. A third step is formed by the connecting rod chamber and the fixed block chamber. The fixed block chamber is connected to or in communication with the slot 61 on the tension rod 4. The spring 73 is located on the inner side face of the spring chamber. The lower end of the spring 73 leans against the second step for positioning the spring 73. The upper end of the spring 73 is located inside the push button chamber. The connecting rod 74 extends through the inside of the spring 73. The upper end of the connecting rod 74 is located inside of the button chamber. The upper end of the connecting rod 74 connects to the push button 76. The shape of the push button 76 corresponds to the button chamber. The upper end of the push button 76 extends out from the button chamber and is located at the top section of the push member 12. The lower end of the push button 76 is associated with the upper end of the spring 73. When the push button 76 is pressed, the lower end of the push button 76 leans against the first step for positioning the push button 76. The lower end of the connecting rod 74 is located inside the connecting rod chamber, and the lower end of the connecting rod 74 connects to the fixed block 75. The fixed block 75 is located inside the fixed block chamber. The shape of the fixed block 75 corresponds to the fixed block chamber. The upper end of the fixed block 75 leans against the third step for positioning the fixed block 75.

Moreover, the guard 13 and the upper end of the base plate 1 are integrated into one piece. The right end surface of the guard 13 and the right end surface of the base plate 1 are preferably at the same level. When pushing the push member 12 toward the left, putting one finger on guard 13 can increase the pushing power on the push member 12.

Furthermore, a mounting hole 60 is located on the base plate 1, near the left side and the right side of the base plate 1 respectively. A positioning tube 89 is formed on the mounting hole 60. A screw, rivet or other fastening element can be used to fasten the binder and contribute to collecting and keeping papers in order. The positioning tube 89 that is close to the right side of the base plate 1 goes through the slot 61 on the tension rod 4, and the shape of the left side of the slot 61 matches the positioning tube 89. The lower end of the positioning tube 89 and the lower end of the base plate 1 are preferably at the same level, making the installation easy and playing positioning role while the tension rod 4 is moving toward right. In a preferred embodiment, a hand rest 43 is formed on the right end surface of the push member 12, in favor of placing the fingers to push the push member 12 easily.

Opening and closing of the ring binder mechanism 83 will now be described. To open the binder, a user uses a hand to press the push button 76. The spring 73 is compressed and the connecting rod 74 and the fixed block 75 move downwardly. The moving of the fixed block 75 drives the movement of the right end of the movable connecting rod 79 downwardly, causing the detachment of the ledge 86 from the right side surface of the base plate 1. When the right end of the sloping block 84 is located at the recess 85 on the right surface of the base plate 1 (after the ledge 86 clears the right side surface of the base plate 1), the tension spring 8 pulls or biases the tension rod 4, thereby driving the movement of the tension rod 4 toward the right. The horizontal part 56 of the top bar 9 detaches from the slot 11 and the inclined part 55 of the top bar 9 pivots upwardly the hinge plates 2. In other words, the inclined opening surface 400 pushes on or contacts the opening edge 49 of straight slot 10, which pushes the hinge boards 2 upwardly. As a result, each pair of the half-ring elements 3 are separated, and the binder is opened.

To close the binder, a user uses a hand to push the push member 12 toward the left and the tension rod 4 moves toward the left. The spring 8 is extended gradually and tensioned. The sloping block 84 is pressed by the surface of the recess 85 while it is going through the recess 85 located on the right end surface of the base plate 1, causing the right end of the movable connecting rod 79 to move downward gradually. This also drives the fixed block 75, the connecting rod 74 and the push button 76 to move downward gradually. The spring 73 is compressed gradually. The spring 73 returns when the sloping block 84 goes through the recess 85, driving the push button 76, the connecting rod 74 and the fixed block 75 to move upward. The movement of the fixed block 75 drives the right end of the movable connecting rod 79 upwardly and the right end of the sloping block 84 leans against the right end inner surface of the base plate 1 (i.e., the ledge 86 engages the right end inner surface of the base plate 1). The spring 8 is extended. The horizontal part 56 of the top bar 9 snaps into the slot 11. The inclined part 55 of the top bar 9 has no force with the hinge plate 2. In other words, the inclined closing surface 401 pushes against or contacts a closing edge 48 of straight slot 10, which pushes the hinge boards 2 downward. The hinge plate 2 closes and each pair of the half-ring elements 3 are closed, and the binder is closed.

This practical invention has a simple structure. One hand is required to open or close it. Manpower is not required. It can be opened easily with little strength. It is easy on the hands. It's very comfortable, easy and convenient to handle the binder. Using one hand to open or close the binder is very convenient, especially when excessive amounts of papers are added. It's time and effort saving. It has long service duration and reduces cost. It meets consumers' demand greatly.

The embodiments described above are preferred embodiments. However, the present invention is not to be limited by the embodiment described above. The present invention may have various changes and modifications as long as they do not depart from the scope of technical idea disclosed herein. All the touches, changes or equivalent replacements made by those skilled in the art to the description above shall be deemed to fall within the scope of protection of this utility model.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A ring binder mechanism for securing loose leaf pages, the ring binder mechanism comprising:

a housing that defines a housing interior, first and second hinge boards positioned in the housing interior and configured to pivot relative to the housing, wherein the first and second hinge boards cooperate to define a slot, wherein the slot includes opposite ends that include a closing edge and an opening edge, the first and second hinge boards being pivotable between a closed position and an open position, a plurality of pairs of semi-rings, each semi-ring including a first ring member mounted on the first hinge board and moveable with the pivoting motion of the first hinge board and a second ring member moveable with the pivoting motion of the second hinge board, the first and second ring members each being pivotable between a closed position and an open position and extending through an opening in the housing, a travel bar positioned below the hinge boards and moveable linearly with respect to the housing and the hinge boards between an open position and a closed position, wherein the travel bar includes at least one top bar extending from a top surface thereof, wherein the top bar includes an inclined opening surface and an inclined closing surface, wherein at least a portion of the top bar extends through the slot in the first and second hinge boards, and wherein the travel bar is biased wherein the travel bar is biased toward the open position by a spring that extends between the travel bar and one of the first and second hinge boards toward the open position, wherein the inclined opening surface of the top bar contacts the opening edge of the slot to pivot the first and second hinge boards to the open position or the inclined closing surface of the top bar contacts the closing edge of the slot to pivot the first and second hinge boards to the closed position, wherein the travel bar is biased toward the open position by a spring that extends between the travel bar and one of the first and second hinge boards.

2. The ring binder mechanism of claim 1 wherein the inclined opening surface of the top bar contacts the opening edge of the slot to pivot the first and second hinge boards to the open position and the inclined closing surface of the top bar contacts the closing edge of the slot to pivot the first and second hinge boards to the closed position.

3. The ring binder mechanism of claim 1 wherein the housing includes a recessed slot defined in an inner surface thereof, wherein the top bar includes a top surface that is received in and is movable along the recessed slot of the housing.

4. The ring binder mechanism of claim 1 wherein the top bar includes a generally horizontal blocking surface adjacent the inclined closing surface, and wherein the closing edge of the slot is positioned adjacent the blocking surface when the first and second hinge boards are in the closed position, such that the blocking surface blocks pivotal movement of the first and second hinge boards.

5. The ring binder mechanism of claim 1 wherein the travel bar includes a push member extending upwardly from an end thereof that is positioned outside the housing interior, and, when the travel bar is in the open position, pushing the push member toward the housing moves the travel bar from the open position to the closed position.

6. The ring binder mechanism of claim 5 further comprising means for holding the travel bar in the closed position.

7. The ring binder mechanism of claim 1 wherein the travel bar includes an elongated positioning slot defined therein, wherein the housing includes a positioning tube extending downwardly from a top thereof and into the positioning slot, and wherein the positioning tube abuts an end of the positioning slot when the travel bar is in the open position.

8. The ring binder mechanism of claim 1 wherein the travel bar includes a push member extending upwardly from an end thereof that is positioned outside the housing interior, wherein the push member includes a button on a side thereof that is biased outwardly therefrom, and wherein when the travel bar is in the closed position the button is in contact with a ledge on the housing.

9. The ring binder mechanism of claim 8 wherein the button includes an extension that is hingedly connected to the travel bar, and wherein at least a part of the extension is positioned adjacent to an angled cut out defined in the travel bar.

10. The ring binder mechanism of claim 1 wherein the travel bar includes a push member extending upwardly from an end thereof that is positioned outside the housing interior, wherein the push member includes an opening mechanism that includes a button that is received in a through chamber in the push member and is biased upwardly, wherein pushing downwardly on the button causes a ledge to clear an edge of the housing, thus allowing the travel bar to move to the open position.

11. A ring binder mechanism for securing loose leaf pages, the ring binder mechanism comprising:

a housing that defines a housing interior, wherein the housing includes rails extending inwardly therefrom, first and second hinge boards positioned in the housing interior and configured to pivot relative to the housing, wherein the first and second hinge boards cooperate to define a slot, wherein the slot includes opposite ends that include a closing edge and an opening edge, the first and second hinge boards being pivotable between a closed position and an open position, a plurality of pairs of semi-rings, each semi-ring including a first ring member mounted on the first hinge board and moveable with the pivoting motion of the first hinge board and a second ring member moveable with the pivoting motion of the second hinge board, the first and second ring members each being pivotable between a closed position and an open position and extending through an opening in the housing, a travel bar positioned below the hinge boards and moveable linearly with respect to the housing and the hinge boards between an open position and a closed position, wherein the travel bar includes at least one top bar extending from a top surface thereof, wherein the top bar includes an inclined opening surface and an inclined closing surface, wherein at least a portion of the top bar extends through the slot in the first and second hinge boards, wherein the travel bar is biased toward the open position, and wherein the travel bar rests on and moves along the rails wherein the inclined opening surface of the top bar contacts the opening edge of the slot to pivot the first and second hinge boards to the open position or the inclined closing surface of the top bar contacts the closing edge of the slot to pivot the first and second hinge boards to the closed position.

12. A ring binder mechanism for securing loose leaf pages, the ring binder mechanism comprising:

a housing that defines a housing interior, first and second hinge boards positioned in the housing interior and configured to pivot relative to the housing, wherein the first and second hinge boards cooperate to define a slot, wherein the slot includes opposite ends that include a closing edge and an opening edge, the first and second hinge boards being pivotable between a closed position and an open position, a plurality of pairs of semi-rings, each semi-ring including a first ring member mounted on the first hinge board and moveable with the pivoting motion of the first hinge board and a second ring member moveable with the pivoting motion of the second hinge board, the first and second ring members each being pivotable between a closed position and an open position and extending through an opening in the housing, a travel bar positioned below the hinge boards and moveable linearly with respect to the housing and the hinge boards between an open position and a closed position, wherein the travel bar includes at least one top bar extending from a top surface thereof, wherein the top bar includes an inclined opening surface and an inclined closing surface, wherein at least a portion of the top bar extends through the slot in the first and second hinge boards, wherein the travel bar is biased linearly toward the open position, and wherein the travel bar includes a first straight slot defined therein, wherein an opening assembly is positioned in the first straight slot and is secured to the housing, wherein the opening assembly is axially extendable and contractable between an open position and a closed position wherein the inclined opening surface of the top bar contacts the openings edge of the slot to pivot the first and second hinge boards to the open position or the inclined closing surface of the top bar contacts the closing edge of the slot to pivot the first and second hinge boards to the closed position.

13. The ring binder mechanism of claim 12 wherein the opening assembly includes a supporting sleeve and a connecting rod that extends through the supporting sleeve, wherein the connecting rod has opposite ends that are connected to the travel bar, and wherein the opening assembly includes a slide claw sheath that contacts an end of the first straight slot.

14. A ring binder mechanism for securing loose leaf page, the ring binder mechanism comprising:

a housing that defines a housing interior, first and second hinge boards positioned in the housing interior and configured to pivot relative to the housing, wherein the first and second hinge boards cooperate to define a slot, wherein the slot includes opposite ends that include a closing edge and an opening edge, the first and second hinge boards being pivotable between a closed position and an open position, a plurality of pairs of semi-rings, each semi-ring including a first ring member mounted on the first hinge board and moveable with the pivoting motion of the first hinge board and a second ring member moveable with the pivoting motion of the second hinge board, the first and second ring members each being pivotable between a closed position and an open position and extending through an opening in the housing, a travel bar positioned below the hinge boards and moveable linearly with respect to the housing and the hinge boards between an open position and a closed position, wherein the travel bar includes at least one top bar extending from a top surface thereof, wherein the top bar includes an inclined opening surface and an inclined closing surface, wherein at least a portion of the top bar extends through the slot in the first and second hinge boards, wherein the travel bar includes a push member extending upwardly from an end thereof that is positioned outside the housing interior, whereby when the travel bar is in the open position, pushing the push member wherein the travel bar is biased toward the open position by a spring that extends between the travel bar and one of the first and second hinge boards toward the housing moves the travel bar from the open position to the closed position and the inclined closing surface of the top bar contacts the closing edge of the slot to pivot the first and second hinge boards to the closed position, and wherein the travel bar is biased toward the open position, wherein the travel bar is biased toward the open position by a spring that extends between the travel bar and one of the first and second hinge boards.

15. The ring binder mechanism of claim 14 wherein the inclined opening surface of the top bar contacts the opening edge of the slot to pivot the first and second hinge boards to the open position.

16. The ring binder mechanism of claim 15 wherein the housing includes a recessed slot defined in an inner surface thereof, wherein the top bar includes a top surface that is received in and is movable along the recessed slot of the housing.

* * * * *